US009289813B2

(12) United States Patent
Flehmig

(10) Patent No.: US 9,289,813 B2
(45) Date of Patent: Mar. 22, 2016

(54) DEVICE AND METHOD FOR THE DEEP DRAWING OF SHELL PARTS WITH INTEGRATED HEAD AND FRAME TRIMMING

(71) Applicant: Thomas Flehmig, Ratingen (DE)

(72) Inventor: Thomas Flehmig, Ratingen (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 0 days.

(21) Appl. No.: 14/327,323

(22) Filed: Jul. 9, 2014

(65) Prior Publication Data

US 2014/0331731 A1 Nov. 13, 2014

Related U.S. Application Data

(63) Continuation of application No. PCT/EP2013/050271, filed on Jan. 9, 2013.

(30) Foreign Application Priority Data

Jan. 12, 2012 (DE) ..... 10 2012 100 230

(51) Int. Cl.
*B21D 24/16* (2006.01)
*B21D 22/20* (2006.01)

(52) U.S. Cl.
CPC ..... *B21D 24/16* (2013.01); *B21D 22/20* (2013.01)

(58) Field of Classification Search
CPC ..... B21D 22/20; B21D 22/208; B21D 22/22; B21D 22/24; B21D 24/16; B21D 28/02; B21D 35/001
USPC ..... 72/327, 334
See application file for complete search history.

(56) References Cited

FOREIGN PATENT DOCUMENTS

| | | | | |
|---|---|---|---|---|
| CN | 1561431 | A | | 1/2005 |
| CN | 201380239 | Y | | 1/2010 |
| CN | 101758148 | A | | 6/2010 |
| CN | 102665956 | A | | 9/2012 |
| DE | 102010000608 | B3 | | 3/2011 |
| DE | 102009059197 | A1 | | 6/2011 |
| JP | 61-023048 | B | | 6/1986 |
| JP | H02 1515 | U | | 1/1990 |
| JP | 09 308920 | A | | 5/1996 |
| JP | 08168830 | A | * | 7/1996 |
| JP | 09314243 | A | | 12/1997 |
| JP | 10249928 | A | | 9/1998 |
| WO | WO 2008/025387 | A1 | | 3/2008 |
| WO | WO 2011/083008 | A1 | | 7/2011 |

* cited by examiner

*Primary Examiner* — Debra Sullivan
(74) *Attorney, Agent, or Firm* — Reinhart Boerner Van Deuren P.C.

(57) ABSTRACT

The invention relates to a device for producing shell components having at least a lower region, a frame region and optionally a flange region from a planar or preformed plate with a drawing die and a drawing punch, the drawing die having a shaping region and at least one cutting region, the shaping region of the drawing die having at the end of the drawing operation the outer shape of the shell component to be drawn and to be cut in the lower region, frame region and optionally in the flange region, the drawing punch having a shaping region and at least one cutting region, the shaping region of the drawing punch having, at the end of the drawing operation, the inner shape of the shell component to be drawn and to be cut with a lower region, frame region and optionally a flange region.

13 Claims, 5 Drawing Sheets

DEVICE AND METHOD FOR THE DEEP DRAWING OF SHELL PARTS WITH INTEGRATED HEAD AND FRAME TRIMMING

CROSS-REFERENCE TO RELATED PATENT APPLICATIONS

This patent application is a continuation of PCT/EP2013/050271, filed Jan. 9, 2013, which claims priority to German Application No. 10 2012 100 230.4, filed Jan. 12, 2012, the entire teachings and disclosure of which are incorporated herein by reference thereto.

FIELD OF THE INVENTION

The invention relates to a device for producing shell components having at least a lower region, a frame region and optionally a flange region from a planar or preformed plate with a drawing die and a drawing punch, the drawing die having a shaping region and at least one cutting region, the shaping region of the drawing die having at the end of the drawing operation the outer shape of the shell component to be drawn and to be cut in the lower region, frame region and optionally in the flange region, the drawing punch having a shaping region and at least one cutting region, the shaping region of the drawing punch having, at the end of the drawing operation, the inner shape of the shell component to be drawn and to be cut with a lower region, frame region and optionally a flange region. The invention further relates to a method for producing shell components.

BACKGROUND OF THE INVENTION

Shell components which have a lower region, a frame region and optionally a flange region are often produced by drawing a planar or preformed plate of metal, preferably steel. There are known from the prior art methods and devices for producing drawn components, particularly ones which have flanges, with which methods and devices drawn components can be produced from a planar plate by deep-drawing and cutting in one working operation. For instance, it is known from the technical book "Schnitt-, Stanz- und Ziehwerkzeuge" (Cutting, punching and drawing tools), Öhler und Kaiser, 8th edition (2001), to construct the drawing die which comprises the lower region, frame region and flange region of the drawn component to be produced, in a vertically displaceable manner in order to cut the finished drawn component at the flange outside the tool components (die and punch) which have been moved together after the drawing operation has been carried out so that, as a result, the desired, flanged drawn component can be produced in one working operation of the drawing punch. A corresponding drawing die is illustrated on page 429 in the technical book mentioned. However, the construction of the cutting/drawing tool which is known from the prior art is relatively complex owing to the vertically displaceable drawing die.

There are further already in the prior art methods and corresponding devices which are for producing drawn components with integrated cutting and which carry out the cutting operation in a stretching/drawing step of the plate in order to prevent scraping of the flange region at the cutting edge of the drawing punch so that, during the cutting operation, the material is under great tensile load and the flange region accordingly follows behind the cut. As a result of the relatively uncontrolled following action of the flange region, drawn components produced in this manner cannot be produced in a dimensionally precise manner with a high level of process reliability. Finally, another problem involves the flange region further having to extend obliquely relative to the frame region in order to prevent scraping on the sharp cutting edge. A frequently desirable, right-angled extent of the flange region relative to the frame region cannot be produced in one method step. Deep-drawing presses do not have highly precise tool guiding so that cutting operations, in particular in the region of the lower region and frame region, are impossible in such presses or can be carried out only with great difficulty and complexity.

Although the Applicant has achieved a solution for cutting the flange region in one working step during drawing with the as yet unpublished German patent application DE 10 2011 050 002.2, a similar problem also exists for the upper cutting of a drawn plate. At least two method steps are currently used, that is to say, drawing the plate and carrying out the cutting. Generally, additional cutting steps are necessary if, in addition, a so-called upper cutting is carried out in the lower region and frame region and optionally in the flange region of a shell component.

SUMMARY OF THE INVENTION

On this basis, an object of the present invention is to provide a device and a method for producing shell components by deep-drawing, with which device or method the production of the shell component and at the same time a dimensionally accurate cutting at least in the frame region and lower region of the shell component can be achieved with as few operating steps as possible.

The mentioned object is achieved in accordance with the teaching of the present invention with a device having the features of the preamble of patent claim 1 in that the cutting region of the drawing punch forms with the shaping region of the drawing die a cutting contour with which, during and at the end of the drawing operation, a separation of the cutting region and shaping region of the plate can be carried out at least in the frame region and lower region of the completely formed shell component, preferably in the final drawing operation.

By the cutting contour being provided between the cutting region of the drawing punch and the shaping region of the drawing die, it is possible for the plate inserted in the drawing die first to move into engagement with the cutting contour in the frame region when the drawing punch is introduced into the drawing die and for the completely drawn shell component to be able to be separated in the lower region when the drawing operation is complete. Therefore, a finished, drawn shell component with lower cutting and frame cutting can be produced in the preferably final drawing operation. The shaping region of the drawing punch or the drawing die forms the region which results in the finished shell component in order to form the substantially planar plate or preformed plate. The cutting region serves to provide material for a defect-free drawing operation so that a, for example, fold-free drawing of the shaping region of the plate is ensured. As a result of the separation of the frame region and lower region of the finished shell component from the cutting region of the plate, a completely shaped and cut shell component can be produced in a preferably final drawing operation.

According to a first embodiment of the device according to the invention, the shaping region of the drawing punch is constructed so as to be recessed in comparison with the cutting region of the drawing punch and the shaping region of the drawing die is constructed so as to be raised in comparison with the cutting region of the drawing die. The height difference between the cutting region and shaping region preferably corresponds to at least the wall thickness of the plate to be shaped. As a result of the shaping region of the drawing punch being constructed in a recessed manner in comparison with the cutting region of the drawing punch, a normal drawing operation is achieved because no additional material is thereby required in the lower region of the plate as a result of the greater drawing depth of the cutting region of the drawing punch. The height difference between the shaping region and cutting region further allows a dimensionally precise and complete separation of the completely produced shell component during and at the end of the drawing operation. It is also conceivable for the cutting region of the drawing punch to be constructed so as to be raised and the shaping region of the drawing die to be constructed so as to be recessed, or for a combination of recessed and raised regions, for example, of the cutting region of the drawing punch with corresponding raised and recessed shaping regions in the drawing die, also to be used.

If the cutting contour of the drawing punch or the drawing die extends through the frame region, lower region and optionally the flange region of the half-shell, the shell component can be completely and cleanly cut out of the shaped plate during the drawing operation. As a result, it is possible, as in a conventional deep-drawing operation, for example, in the flange region, to provide additional material which can subsequently flow during the drawing operation in order specifically to form the flange region. Excess material can then be removed from the shell component via the cutting contour so that highly dimensionally accurate edge regions of the shell component can also be provided, for example, in the flange region.

In order to reduce the cutting forces which occur during the drawing operation, according to another embodiment of the device, the cutting contour between the cutting region of the drawing punch and the shaping region of the drawing die has engagement depths which vary in a longitudinal direction in the lower region and optionally in the flange region. The varying engagement depths ensure that, during the introduction of the drawing punch into the drawing die, the shaping regions or cutting regions of the drawing punch and drawing die which have become engaged move into engagement shortly before the end of the drawing operation at different introduction depths of the drawing punch and therefore a continuous separation process along the cutting contour which begins in a point-like or zonal manner is ensured. Since the shaping region and the cutting region of the drawn plate are not simultaneously separated along the entire length of the cutting contour, it is ensured that the cutting forces remain moderate and the "cutting shock" known in technical circles can be substantially prevented.

The different engagement depths between the shaping region and the cutting region of the drawing punch and/or the drawing die are preferably provided by an introduction contour which is provided. The introduction contour may have different shapes. Thus, for example, it is possible to ensure different engagement depths by means of a linear introduction contour which has inclinations which vary in the direction of the cutting contour.

According to another embodiment of the device according to the invention, a round introduction contour is provided in the drawing punch at least partially in regions of the cutting contour of the drawing punch, in which regions a cutting edge is arranged in the corresponding region of the drawing die and/or a cutting edge is provided at least partially in the drawing punch in the regions of the cutting contour of the drawing die, in which regions a round introduction contour is provided in the drawing die. As a result of the combination of the round introduction contour, that is to say, the introduction contour has a radius instead of a "sharp" cutting edge, and a "sharp" cutting edge, an improved centering of the drawing punch in the drawing die can simultaneously be carried out during the drawing operation when the cutting operation is begun. Particularly precise cutting guiding is thereby produced. It is also conceivable to use two mutually striking "sharp" cutting edges.

At least the portions of the drawing punch and/or the drawing die forming the cutting contour are preferably in the form of exchangeable inserts because they are subjected to increased wear and can then be readily exchanged.

According to another embodiment of the device, a planar plate support region may optionally be provided so that the plate can be readily inserted into the device before the shaping and cutting operation, for example, automatically.

According to a subsequent embodiment of the device, it was possible to achieve particularly good cutting results in that the introduction contour has at least a radius of 0.5 mm and the cutting edge has a radius of a maximum of 0.05 mm, in particular a maximum of 0.02 mm. Particularly good centering of the drawing punch is thereby achieved when the plate is drawn and cut so that it is possible to ensure very good dimensional accuracy.

Finally, the material flow can be further controlled during the drawing operation in that a retention member is provided for retaining the plate to be drawn during the drawing operation.

According to a subsequent teaching of the present invention, the object set out is achieved by a method for producing shell components having a lower region, frame region and optionally a flange region from a planar or preformed plate by drawing using the device according to the invention, a plate composed of metal, preferably steel, being inserted into the device and the plate being drawn by introducing the drawing punch into the drawing die and being cut by the provided cutting contour during the shaping operation at least in the lower region and frame region so that a cutting region and a shaping region of the plate is at least partially separated and a finished shell component which substantially has the shape of the shaping region of the drawing punch and the drawing die is produced. As already explained above, it is possible by means of the method according to the invention using the device according to the invention for a shell component to be able to be produced from a planar or preformed plate, preferably in a final drawing operation, which component is simultaneously cut at least in the lower region and frame region. Shell components can be produced with the method according to the invention in a particularly economical manner.

According to an embodiment of the method, the shell component formed by the shaping region of the drawing punch and the drawing die is completely separated from the cutting region when the drawing operation is finished.

Alternatively, it is also possible according to another embodiment of the method to leave behind material, preferably in the form of webs, in regions along the cutting line, that is to say, to produce an interrupted cutting line, whereby the shell component is still connected at least partially to the cutting region and can be removed from the tool at the same time. In another separation process, the cutting region can then be separated from the useful portion.

In order to keep the cutting forces during the cutting of the plate at a moderate level and to substantially prevent the so-called "cutting shock", the cutting of the plate is preferably carried out in the lower region and optionally in the flange region at least partially continuously beginning from the regions of the cutting contour initially in engagement between the shaping region and the cutting region of the drawing punch and the drawing die. By the complete cutting contour not being in engagement in the case of a specific introduction depth of the drawing punch, it is possible to obtain a continuous cut of the plate during the drawing operation or at the end of the drawing operation.

Finally, it is particularly advantageous in the case of steel plates if those plates are shaped in the hot state. In the case of hot-shaping of a steel plate, the plate is preferably heated to a temperature above the AC3 temperature point and hot-shaped so that a readily shapeable structure is provided in the plate. If the plate is quenched in the closed state of the tool, compression hardening can be achieved if the material of the plate allows conversion into a substantially martensitic structure.

BRIEF DESCRIPTION OF THE DRAWINGS

The invention is intended to be explained in greater detail below with reference to embodiments in conjunction with the drawings, in which.

DETAILED DESCRIPTION OF THE INVENTION

Figure 1A:
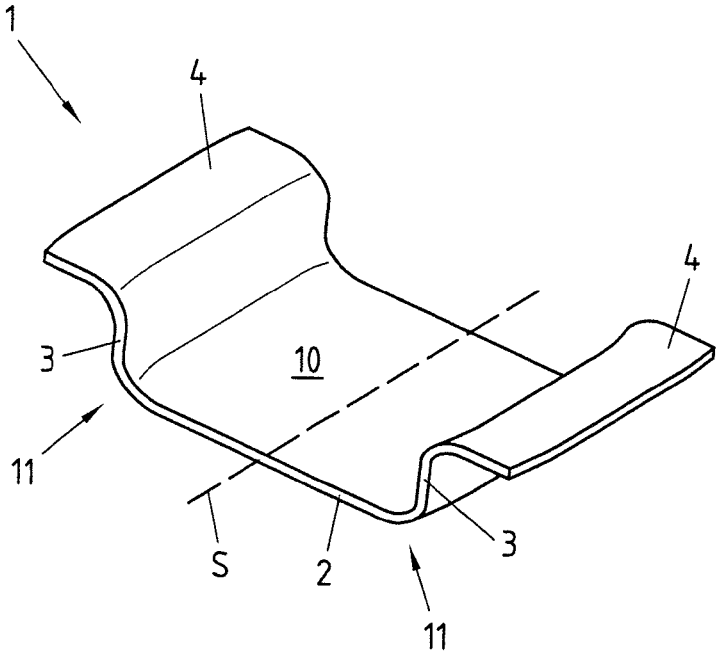
FIG. 1*a*) is a perspective view of a typical shell component which is intended to be produced with the device according to the invention.

First, FIG. 1*a*) is a perspective view of a shell component 1 having a lower region 2, a frame region 3 and a flange region 4. A corresponding shell component 1 may be used, for example, to produce a carrier of a motor vehicle, the shell component 1 being connected, for example, to another shell component via the flanges 4, and thus being able to form a stable hollow member. FIG. 1*a*) further shows a line of section S which indicates the line of section in which FIGS. 2 to 4 are illustrated.

Figure 1B:
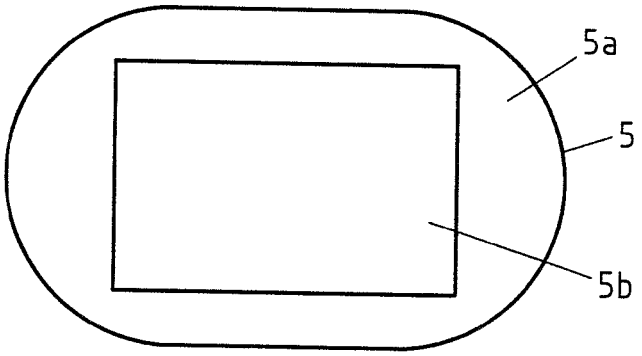
FIG. 1*b*) is a schematic top view of a plate to be shaped before the drawing and cutting actions.

The starting material may be, for example, the plate 5 which is shown in FIG. 1*b*) as a schematic top view and which has a cutting region 5*a* and a shaping region 5*b*, in the present embodiment the cutting region 5*a* being arranged so as to extend around the shaping region 5*b*. The cutting region 5*a* forms the region of the plate that is no longer part of the finished shell component 1 after the shaping and cutting operations. Corresponding cutting and shaping regions are also provided in the device for producing the shell components in order to shape the different regions in a different manner and to separate them from each other.

Figure 2:
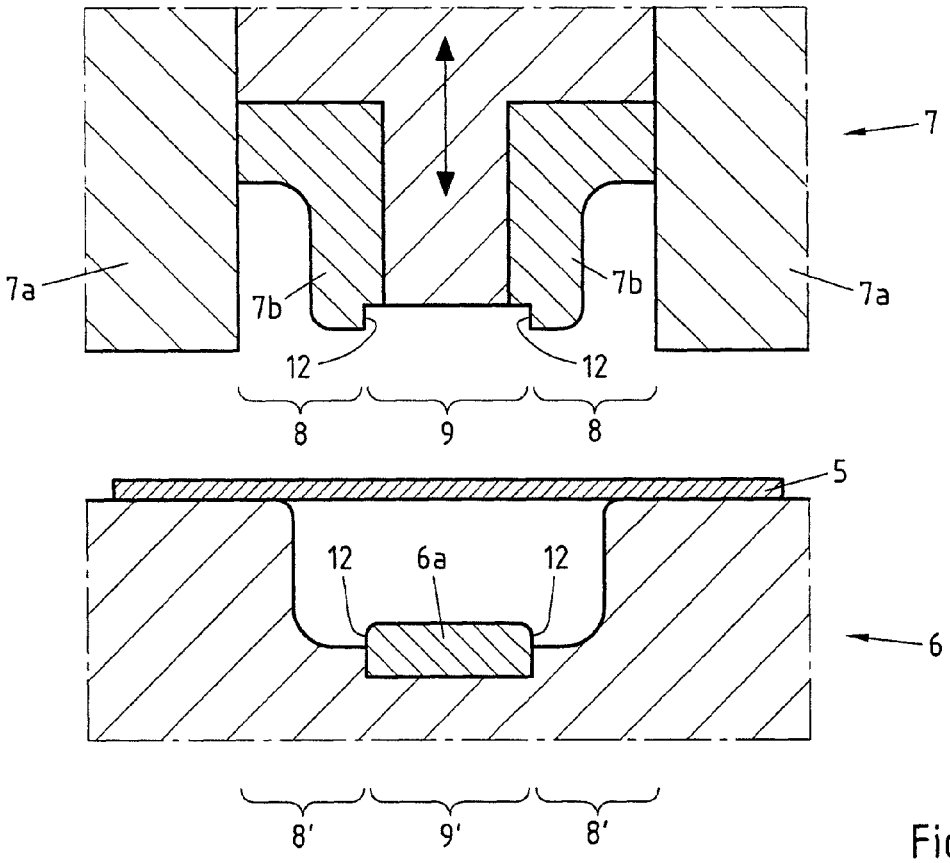
FIGS. 2 to 4 are schematic cross-sections along the line of section S in FIG. 1*a*) of an embodiment of a device with a plate inserted at different times of the drawing operation.

An embodiment of a device for producing a shell component 1 from a plate 5 along the line of section S is illustrated in FIG. 2. FIG. 2 shows a planar plate 5 which is inserted into a drawing die 6. The drawing punch 7 comprises two retention members 7*a* with which the material introduction can be controlled during the drawing operation. The drawing punch 7 further has a cutting region 8 and a shaping region 9. The drawing die 6 also has a cutting region 8' and a shaping region 9'. The shaping region 9 of the drawing punch 7 has the inner shape 10 (FIG. 1) of the shell component and the shaping region 9' of the drawing die 6 has the outer shape 11 of the finished shell component 1. The cutting region 8 of the drawing punch 7 forms with the shaping region 9' of the drawing die a cutting contour 12 which allows separation of the shaping region 5*b* of the shaped plate 5 and therefore the shell component 1 at least in the lower region 2 and in the frame region 4 from the cutting region 5*a* of the plate 5. The separation is carried out during the drawing operation as shown in FIGS. 3 and 4. The cutting contour 12 is provided both in the drawing punch 7 and in the drawing die 6, preferably by inserts 7*b*, 6*a*, in order to be able to carry out simple exchange in the event of wear.

Figure 3:
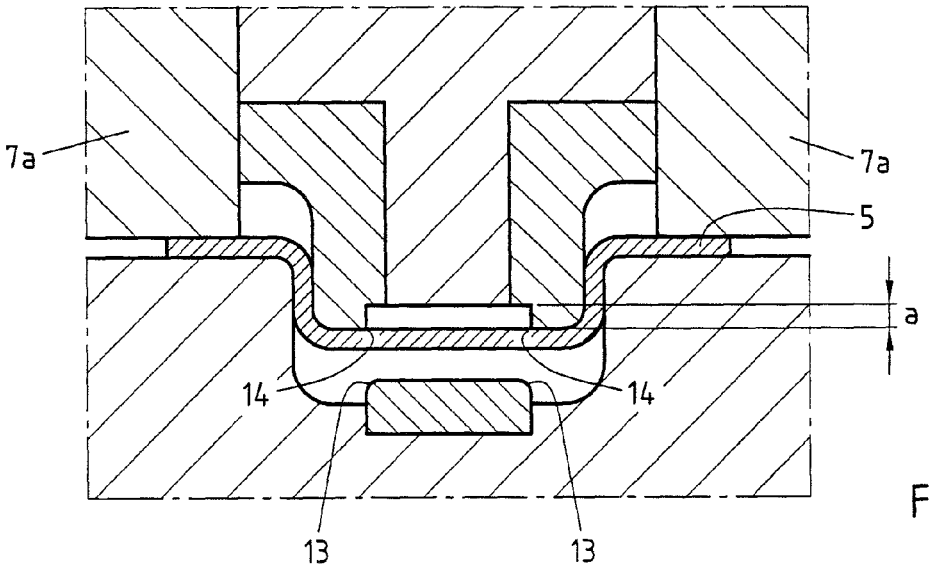
Figure 4:
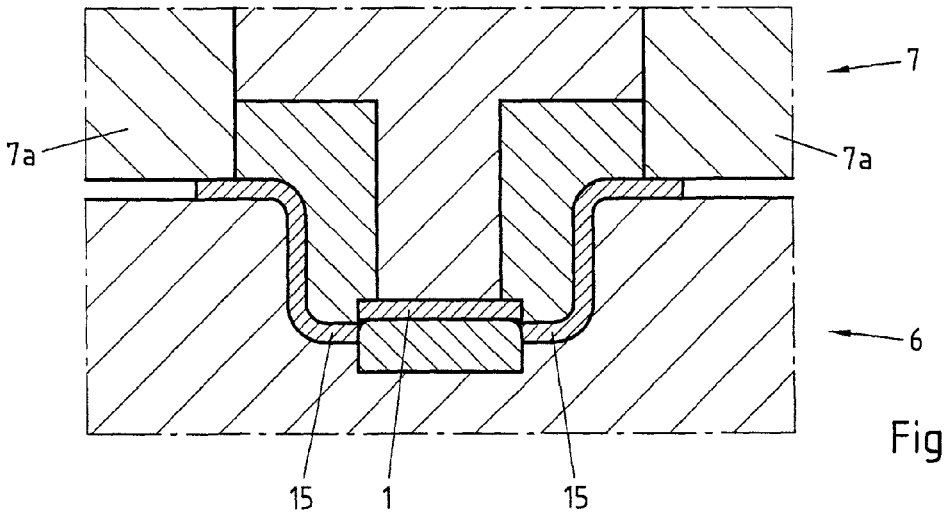

As illustrated in FIG. 3, the drawing punch 7 is first introduced into the drawing die 6 and shapes the plate 5 with the projecting cutting region 8 in such a manner that the plate is drawn in a fold-free manner in the shaping region 9 and 9' of the drawing die 6 and drawing punch 7, respectively. This is ensured, for example, in that, as illustrated in the present embodiment of FIGS. 3 and 4, the shaping region 9 of the drawing punch is constructed so as to be recessed relative to the cutting region 8 of the drawing punch, the height difference a between the cutting region and the shaping region of the drawing punch being at least the wall thickness of the plate. As also illustrated in FIG. 3, the shaping region 9' of the drawing die has a rounded introduction member 13 at the transition to the cutting region 8'. That rounded introduction member 13 improves centering of the drawing punch without complex guiding means together with the cutting edge 14 provided in the drawing punch at the transition from the shaping region 9 to the cutting region 8. If the drawing punch 7 is now introduced even more deeply into the drawing die 6 and reaches its end position, the shell component 1 in the shaping region is separated from the cutting region 15 of the shaped plate by means of the cutting edge 14 and the rounded introduction member 13 so that the cutting line extends through the frame region 3 and the lower region 2 of the shell component 1. The cutting region 8 of the drawing punch 7 and the cutting region 8' of the drawing die 6 also preferably extend so as to extend round the flange region 4 of the finished shell component 1, respectively, so that the edges of the flange region 4 are cut during the drawing operation and are therefore free from influence in respect of the drawing operation.

Figure 5:
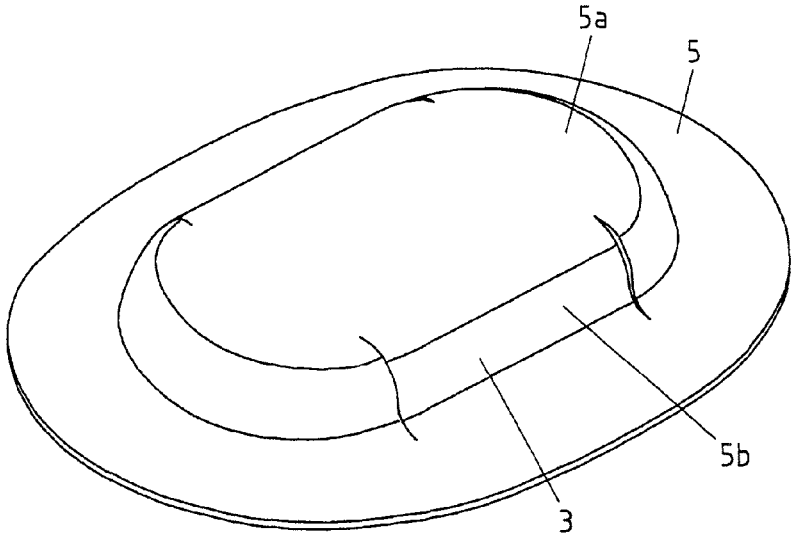
FIGS. 5 and 6 are perspective views of an embodiment of a deep-drawn and cut plate at different times of the drawing operation.
Figure 6:
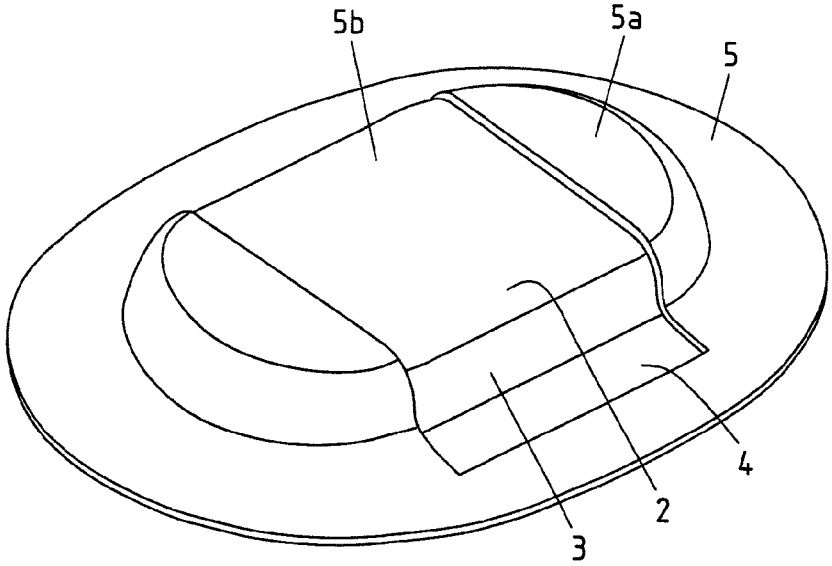

FIGS. 5 and 6 are perspective illustrations of the drawing and cutting operation in respect of a shaped plate 5 which has a cutting region 5*a* and a shaping region 5*b*. As may be seen in FIG. 5, the cutting operation begins at the frame 3 of the subsequent shell component 1 during the drawing operation. When the drawing operation continues, the shell component 1 or the shaping region 5*a* of the plate is completely separated before the drawing operation is finished, FIG. 6. The cutting is preferably carried out both in the frame region 3 and in the lower region 2. In the embodiment illustrated, the flange region 4 is further cleanly cut at the end of the drawing operation.

Figure 7:
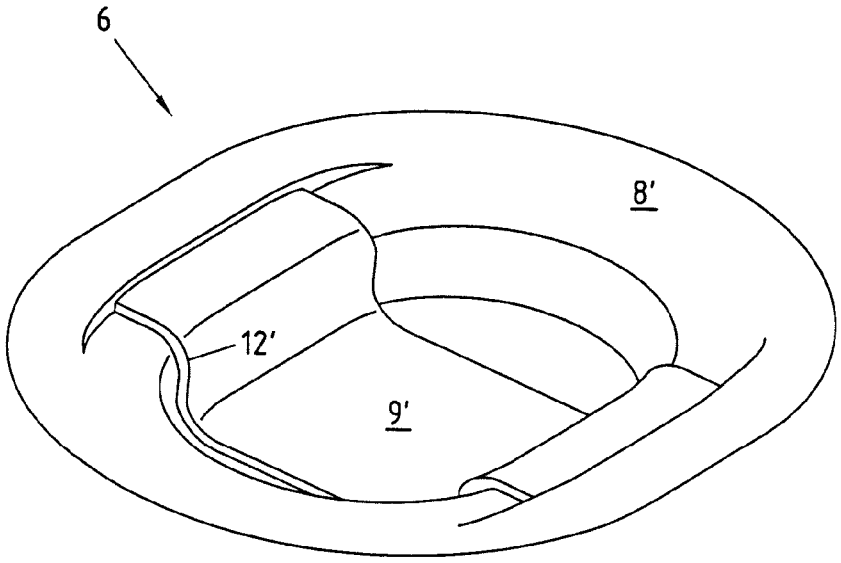
FIG. 7 is a perspective view of the drawing die of the embodiment of FIGS. 2 to 6.
Figure 8:
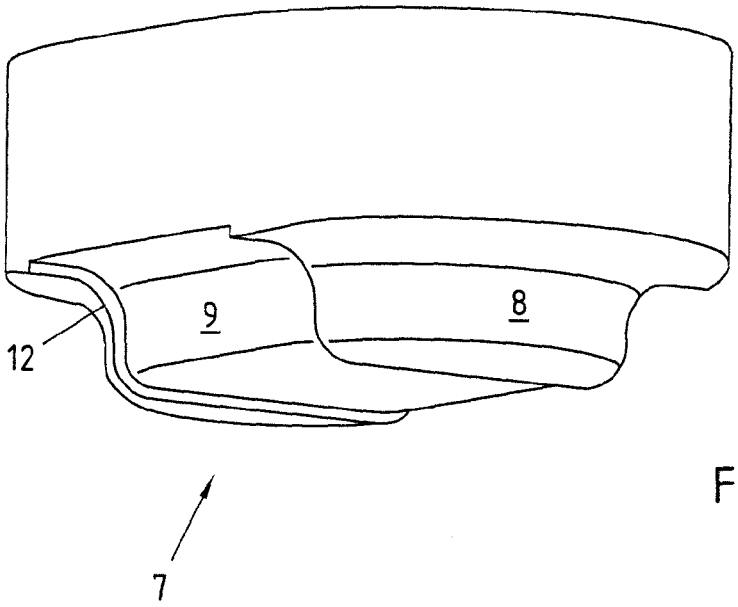
FIG. 8 is a perspective view of the drawing punch of the embodiment from FIGS. 2 to 6 and FIG. 9 schematically shows an exemplary extent of the engagement depth along the cutting contour in the lower region and optionally in the flange region.

FIG. 7 and FIG. 8 are perspective views of an embodiment of the drawing punch 7 and the drawing die 6, respectively. FIG. 7 clearly shows that the shaping region 9' in the drawing die is raised relative to the directly adjacent cutting region 8'. Conversely, the shaping region 9 is constructed in a recessed manner relative to the directly adjacent cutting region 8 in the drawing punch 7 which is illustrated in FIG. 8. It is thereby possible for the plate to be able to be drawn in a fold-free manner without becoming damaged by the "sharp" edges of the tool by means of the projecting regions of the cutting region 8 of the drawing punch 7 in order subsequently to take on the shape of the shaping region 9' or 9 of the drawing die 6 or the drawing punch 7, respectively. At the same time, the shell component 1 is completely cut by means of the cutting contour 12 of the drawing punch 7 and cutting contour 12' of the drawing die 6, respectively. In the frame region, there is produced complete overlap of the cutting edges of the drawing punch 7 and the drawing die 6.

Figure 9:
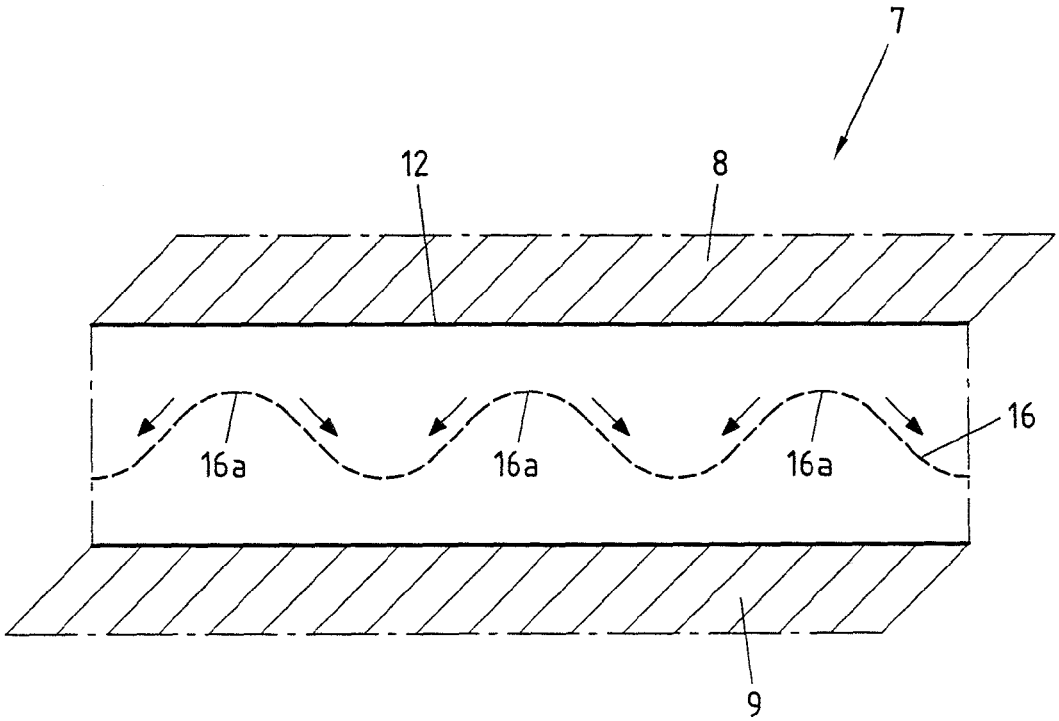

FIG. 9 schematically illustrates the cutting contour 12 of the drawing punch 7 for the lower region and optionally the flange region. The engagement depth 16, that is to say, the depth at which the drawing punch 7 and the drawing die 6 engage and cut the plate 5, is illustrated as a cutting line 16. The cutting line 16 has a varying depth so that the cutting process initially begins in the regions 16*a* and continues in the direction of the arrow with increasing depth of introduction of the drawing punch. The cutting forces can thereby be kept at a moderate level. Different shapes are conceivable for the extent of the engagement line 7 of the cutting contour 12, for example, a linear extent, a wave-like extent or, for example, a saw-tooth-like extent.

In the embodiment illustrated, the drawing punch 7 is provided with a recessed shaping region 9. The drawing die 6 of the embodiment has a raised shaping region 9'. However, it is also conceivable, as set out above, for the drawing die 6 to have a recessed shaping region and for the drawing punch 7 to have a projecting shaping region, or for a combination of the two to be provided.

By the device according to the invention being used, as already explained, a planar plate 5 or, for example, preformed plate 5 can be shaped in a final drawing operation to form a shell component 1 having an optional flange region 4 and can be completely cut at the same time. The typical upper cutting of the drawing components, which cutting is generally carried out in a plurality of working operations, is then no longer necessary. Shell components 1 can thereby be produced in a substantially more economical manner.

The invention claimed is:

1. Device for producing shell components having at least a lower region, a frame region and optionally a flange region from a planar or preformed plate comprising a drawing die and a drawing punch, the drawing die having a shaping region and at least one cutting region, the shaping region of the drawing die having at the end of the drawing operation the outer shape of the shell component to be drawn and to be cut in the lower region, frame region and optionally in the flange region, the drawing punch having a shaping region and at least one cutting region, the shaping region of the drawing punch having, at the end of the drawing operation, the inner shape of the shell component to be drawn and to be cut with a lower region, frame region and optionally a flange region, wherein the cutting region of the drawing punch forms with the shaping region of the drawing die a cutting contour with which, during and at the end of the drawing operation, a separation of a cutting region and a shaping region of the plate can be carried out at least in the frame region, lower region and optionally in the flange region of the completely formed shell component, preferably in the final drawing operation, wherein the completely drawn shell component can be separated in the lower region when the drawing operation is complete.

2. Device according to claim 1, wherein the shaping region of the drawing punch is constructed so as to be recessed in comparison with the cutting region of the drawing punch and the shaping region of the drawing die is constructed so as to be raised in comparison with the cutting region of the drawing die.

3. Device according to claim 1, wherein the cutting contour extends through the frame region, lower region and flange region of the shell component.

4. Device according to claim 1, wherein the cutting contour between the cutting region of the drawing punch and the shaping region of the drawing die has engagement depths which vary in a longitudinal direction in the lower region and optionally in the flange region.

5. Device according to claim 1, wherein an introduction contour is provided between the shaping region and the cutting region of the drawing punch and/or the drawing die.

6. Device according to claim 1, wherein a round introduction contour is provided in the drawing punch at least partially in regions of the cutting contour of the drawing punch, in which regions a cutting edge is arranged in the corresponding region of the drawing die and/or a cutting edge is provided at least partially in the drawing punch in the regions of the cutting contour of the drawing die, in which said regions a round introduction contour is provided in the drawing die.

7. Device according to claim 1, wherein the portions of the drawing punch and/or the drawing die forming the cutting contour are in the form of exchangeable inserts.

8. Device according to claim 1, wherein the introduction contour has at least a radius of 0.5 mm and the cutting edge has a radius of a maximum of 0.05 mm.

9. Device according to claim 1, wherein a retention member is provided for retaining the plate to be drawn during the drawing operation.

10. Method for producing shell components having a lower region, frame region and an optional flange region from a planar or preformed plate by drawing using a device according to claim 1, comprising:

inserting the plate into the device and drawing the plate by introducing the drawing punch into the drawing die; and cutting the plate by the provided cutting contour during the shaping operation at least in the lower region and frame region so that a cutting region and a shaping region of the plate is at least partially separated and a finished shell component which substantially has the shape of the shaping region of the drawing punch and the drawing die is produced.

11. Method according to claim 10, wherein the shell component drawn by the shaping region of the drawing punch and the drawing die is completely separated from the cutting region of the plate when the drawing operation is finished.

12. Method according to claim 10, wherein the cutting of the plate is carried out in the lower region and optionally in the flange region at least partially continuously beginning from the regions of the cutting contour initially in engagement between the shaping region and the cutting region of the drawing punch and the drawing die.

13. Method according to claim 10, wherein the plate is shaped in the hot state.

* * * * *